US008011280B2

(12) United States Patent
Liebheit

(10) Patent No.: US 8,011,280 B2
(45) Date of Patent: Sep. 6, 2011

(54) ROTARY CUTTER FOR TRIMMING PRINTED PRODUCTS CONVEYED IN AN OVERLAPPING FLOW

(75) Inventor: Stefan Liebheit, Staufen (CH)

(73) Assignee: Mueller Martini Holding AG, Hergiswil (CH)

( * ) Notice: Subject to any disclaimer, the term of this patent is extended or adjusted under 35 U.S.C. 154(b) by 17 days.

(21) Appl. No.: 12/068,079

(22) Filed: Feb. 1, 2008

(65) Prior Publication Data

US 2008/0202304 A1 Aug. 28, 2008

(30) Foreign Application Priority Data

Feb. 2, 2007 (EP) ..... 07405027

(51) Int. Cl.
*B26D 5/00* (2006.01)

(52) U.S. Cl. ..... 83/74; 83/73; 83/76; 83/494; 83/500

(58) Field of Classification Search ..... 83/51, 72–75, 83/76, 491–495, 500–503, 676, 885
See application file for complete search history.

(56) References Cited

U.S. PATENT DOCUMENTS

| | | | | |
|---|---|---|---|---|
| 987,012 | A * | 3/1911 | Perkins | 144/37 |
| 2,599,430 | A * | 6/1952 | Beuerman | 83/76 |
| 3,813,981 | A | 6/1974 | Faltin | |
| 4,009,741 | A * | 3/1977 | Zimmerman | 144/41 |
| 4,205,568 | A * | 6/1980 | Foster | 83/75.5 |
| RE30,757 | E * | 10/1981 | Gerber | 83/74 |
| 4,480,518 | A * | 11/1984 | Futterer | 83/508 |
| 4,566,360 | A * | 1/1986 | Lehmann | 83/409 |
| 4,644,832 | A * | 2/1987 | Smith | 83/72 |
| 5,197,364 | A * | 3/1993 | Heutschi | 83/29 |
| 6,167,324 | A * | 12/2000 | Gorman | 700/171 |
| 6,692,424 | B2 * | 2/2004 | Pasman et al. | 493/324 |
| 7,017,460 | B2 * | 3/2006 | Virvalo et al. | 83/13 |
| 7,178,436 | B2 * | 2/2007 | Wilson | 83/62.1 |
| 2006/0065091 | A1 | 3/2006 | Liebheit | |
| 2008/0028902 | A1 * | 2/2008 | Baggot et al. | 83/13 |

FOREIGN PATENT DOCUMENTS

DE 76 40 062 U1 9/1978

(Continued)

OTHER PUBLICATIONS

European Search Report dated Jul. 12, 2007 issued in Priority Application No. 07405027.9.

*Primary Examiner* — Edward Landrum
(74) *Attorney, Agent, or Firm* — Venable LLP; Robert Kinberg; Ryan M. Flandro

(57) ABSTRACT

A rotary cutter for trimming printed products conveyed in an overlapping flow. The rotary cutter including a first knife that rotates and a second knife that rotates counter to the first knife. The second knife is arranged to operate jointly with the first knife. At least one of the knives includes a plurality of blades distributed over a circumference. A conveying device conveys the overlapping flow between the first knife and the second knife. A control unit controls the rotational speed of at least one of the first knife and the second knife. The rotational speed of at least one of the knives is predetermined based on at least one of the speed value for the conveying device or a thickness value of the overlapping flow.

17 Claims, 3 Drawing Sheets

FOREIGN PATENT DOCUMENTS

| | | | |
|---|---|---|---|
| DE | 196 29 561 | A1 | 2/1998 |
| DE | 197 43 853 | C1 | 11/1998 |
| EP | 0 330 729 | A | 9/1989 |
| EP | 1 283 094 | | 2/2003 |
| EP | 1 510 288 | A1 | 3/2005 |
| EP | 1 637 295 | | 3/2006 |
| EP | 1 724 077 | A | 11/2006 |
| SU | 1 608 714 | | 11/1990 |

* cited by examiner

ROTARY CUTTER FOR TRIMMING PRINTED PRODUCTS CONVEYED IN AN OVERLAPPING FLOW

CROSS-REFERENCE TO RELATED APPLICATION

This application claims the priority of European Patent Application No. 07405027.9, filed on Feb. 2, 2007, the subject matter of which is incorporated herein by reference.

BACKGROUND OF THE INVENTION

The invention relates to a device for trimming printed products conveyed in an overlapping flow, the device comprising a rotating first knife that operates jointly with a counter-rotating second knife, between which an overlapping flow is conveyed by a conveying device, wherein at least one of the knives is embodied so as to have a plurality of blades distributed along the circumference of the knife and wherein the device is provided with a control unit for controlling the operation of the knives. A rotary cutter of this type is described in the U.S. Pat. No. 3,813,981. The geometric arrangement of the blades along the circumference of one of the two rotating knives makes it possible to prevent the printed products from being displaced during the trimming operation. For that reason, the circumferential speed of the knife provided with the blades must be adapted precisely to the conveying speed of the device for conveying the printed products. To be able to process even thick printed products in an overlapping flow with high production capacity and good trimming quality, the knives of rotary cutters are embodied as shown in the European patent document EP-A-1 510 288. The blades must be re-sharpened regularly because any wear on the knives reduces the trimming quality. This re-sharpening operation is comparatively involved and expensive. A replacement of one or more of the knives furthermore results in a shutdown period, for example ranging from 10 to 30 minutes.

SUMMARY OF THE INVENTION

It is therefore an object of the present invention to create a rotary cutter of the aforementioned type, provided with blades that do not show wear as quickly, thereby making it possible to have a longer service life.

The above and other objects are achieved according to the invention, wherein there is provided, in one embodiment, a rotary cutter for trimming printed products, conveyed in an overlapping flow, the rotary cutter comprising: a first knife that rotates; a second knife that rotates counter to the first knife, wherein the second knife is arranged to operate jointly with the first knife; at least one of the first knife or the second knife including a plurality of blades distributed over a circumference of at least one of the first knife or the second knife; a conveying device to convey the overlapping flow between the first knife and the second knife; and a control unit coupled to control the rotational speed of at least one of the first knife and the second knife, wherein the rotational speed of at least one of the knives is predetermined based on at least one of the speed value for the conveying device or a thickness value of the overlapping flow.

The idea behind the invention is based on the finding that rotary cutters of this type frequently utilize only the tips of the blades for the trimming. The individual blades consequently wear down faster in a small partial region, resulting in a less than optimum use of the blade. For an optimum use, approximately 70% of the blade would be utilized which, as a rule, is the case only if the trimming occurs at maximum thickness and at maximum speed of the product flow. With extremely thin products or low conveying speeds, however, only the tip of a blade is engaged, resulting in the aforementioned, extremely rapid wear. By controlling the speed as disclosed in the invention, the circumferential speed of at least one knife can always be adapted optimally to the products to be trimmed, even if the characteristics change. The thickness of the product flow and the conveying speed may be used as the product flow characteristics in this case. However, other characteristics can also be used for controlling the product flow, for example the type of material and especially the type of paper used for the products.

According to one embodiment of the invention, at least one of the knives is driven by a speed-controlled motor, thereby resulting in a particularly simple and precise control of the rotational speed for the respective knife.

According to a different embodiment of the invention, each of the two knives is driven by a speed-controlled motor. In that case, the two knives can be adapted precisely, independent of each other, and comparatively easily to the characteristics of the product flow or the products to be controlled. The service life of the two knives can thus be extended even more.

According to yet another embodiment of the invention, the force that must be generated at the driven knife shaft is measured and the resulting value is then used for checking the trimming condition. It is thus possible to ensure that the blades are respectively re-sharpened or replaced at the optimum point in time, which furthermore avoids any unfavorable trimming quality as a result of worn blades.

The characteristics used for controlling the at least one knife include the thickness of the product flow and the conveying speed. The use of one or more additional characteristics can reduce the blade wear even further. For example, the type of paper in particular can be used as another characteristic of the products.

According to yet another embodiment of the invention, a measuring device is used if the thickness of the products or the product flow is used as a variable for controlling the at least one knife, for example a sensor which determines the thickness of the product flow and subsequently supplies this value to the respective control or regulating device. The conveying speed can also be determined with a suitable measuring device. However, it is also possible in principle to take over the speed directly from the conveying device, for example a conveying belt.

BRIEF DESCRIPTION OF THE DRAWINGS

These and other features and advantages of the invention will be further understood from the following detailed description with reference to the accompanying drawings, which show in.

DETAILED DESCRIPTION

Figure 1:
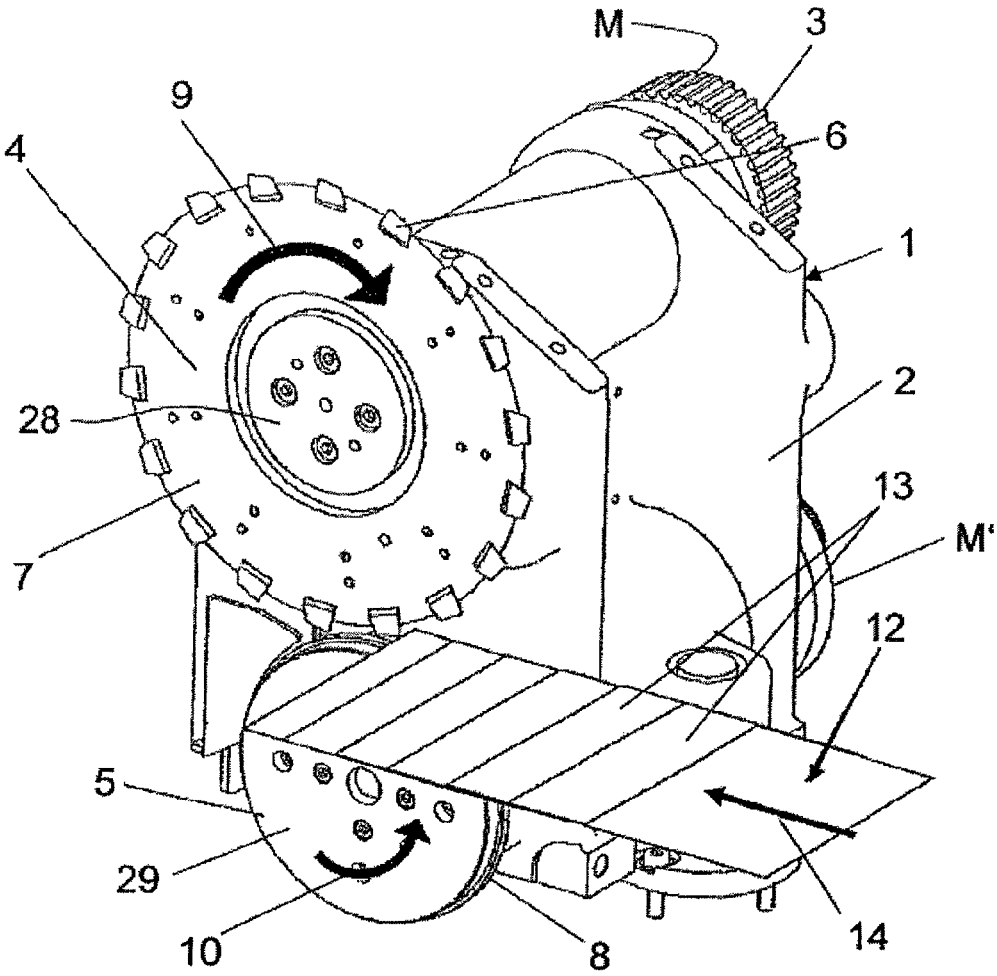
FIG. 1 A schematic, three-dimensional view of a rotary cutter according to the invention.
Figure 2:
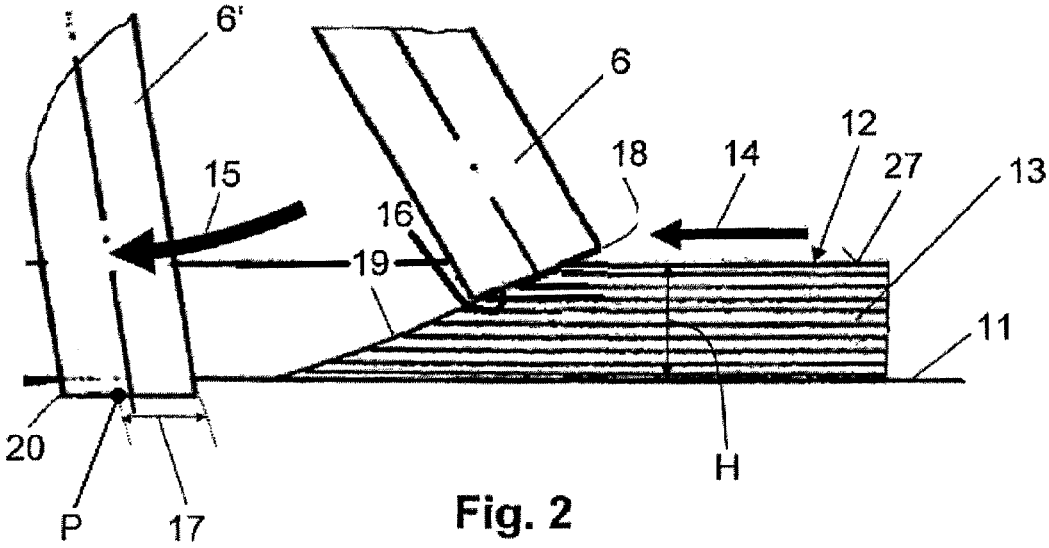
FIG. 2 A schematic partial side view of two blades and the product flow, designed to illustrate the trimming operation.

Referring to FIG. 1, there is shown a rotary cutter 1 used for trimming products 13 conveyed in a product flow 12, in particular printed products such as newspapers, magazines, folded sheets and signatures, as well as individual sheets. The products 13 in particular are conveyed in an overlapping flow 12. The products 13 arrive, for example, from a rotary printing machine that is not shown herein and are conveyed in a conveying device 11 in the direction of the arrow 14, as shown in FIG. 2. The conveying device 11 can be embodied in a manner known per se, for example in the form of a belt conveyor. The conveying device 11 generally operates at a constant speed that is predetermined, for example, by upstream-connected machines and in particular a printing machine. The speed of the conveying device 11 can vary considerably, depending on the product 13, and can thus be comparatively slow or extremely fast, wherein the speed can range up to about 1.2 m/s. The products 13 are trimmed in a longitudinal direction of the overlapping flow 12 by trimming off an edge of the product 13, which is not shown in further detail herein.

The rotary cutter 1 has a machine frame 2 with a rotating first knife 4 and second knife 5 positioned on the machine frame. In the embodiment of FIG. 1, the first knife 4 is illustrated above second knife 5. The knife 4 has a knife shaft, known per se and not shown herein, which is positioned in the machine frame 2. This knife shaft extends parallel to a knife shaft for the second knife 5, which is also positioned inside the machine frame 2. The knife shaft for the second knife 5 can be embodied to be displaceable in a longitudinal direction for adjusting the cutting gap between the first knife 4 and the second knife 5, as disclosed in EP 1 637 295 A.

The first knife 4 is a so-called segment knife, comprising a disc 7 as a carrier, which is attached with a flange 28 to a knife shaft that is not shown herein. A plurality of blades 6 of hard metal or another suitable material are clamped onto the knife in circumferential direction of the disc 7, wherein these blades 6 are also called knife cutters. According to FIG. 2, they are respectively provided with a cutting edge 16 for trimming the products 13. These cutting edges 16 must be sharpened periodically, for example as described in EP 1 510 288 A. Each cutting edge 16 extends between a tip 18 and corner 20.

The first knife 4 is driven by a motor M that acts via a gear 3 upon the knife shaft of the first knife 4, wherein this gear is only indicated herein. The first knife 4 is driven in the direction of arrow 9. The motor M may be an electric motor and further may be a speed-controlled servo-motor.

The second knife 5 consists of a ring 8 which is attached to a disc-shaped support 29, wherein the ring 8 in particular is made of hard metal and can be glued to the support 29. The ring has an inside area, not shown herein, which can be re-sharpened. A cutting gap ranging from about 0.03 mm to about 0.035 mm exists between this inside area and the blades 6. The second knife 5 is driven in the direction of arrow 10. The drive can be a passive drive, meaning the speed of the second knife 5 automatically adjusts to the speed of the first knife 4. However, the second knife 5 can also be actively driven by the motor M, with the aid of a gear that is not shown herein. Finally, the second knife 5 can also be driven by a separate motor M' which acts via a gear, not shown herein, upon the knife shaft for the second knife 5. This motor M', which is indicated in FIG. 1, is also an electric motor and may be a speed-controlled servo-motor.

With the rotary cutter 1 according to FIG. 1, the first knife 4 is installed on the top and the second knife 5 is installed on the bottom. However, a design is also conceivable where the second knife 5 is embodied as the segment knife and the overlapping flow 12 is trimmed from below. The overlapping flow 12 in that case is formed such that the edges of the products 13 are on the bottom.

Figure 3:
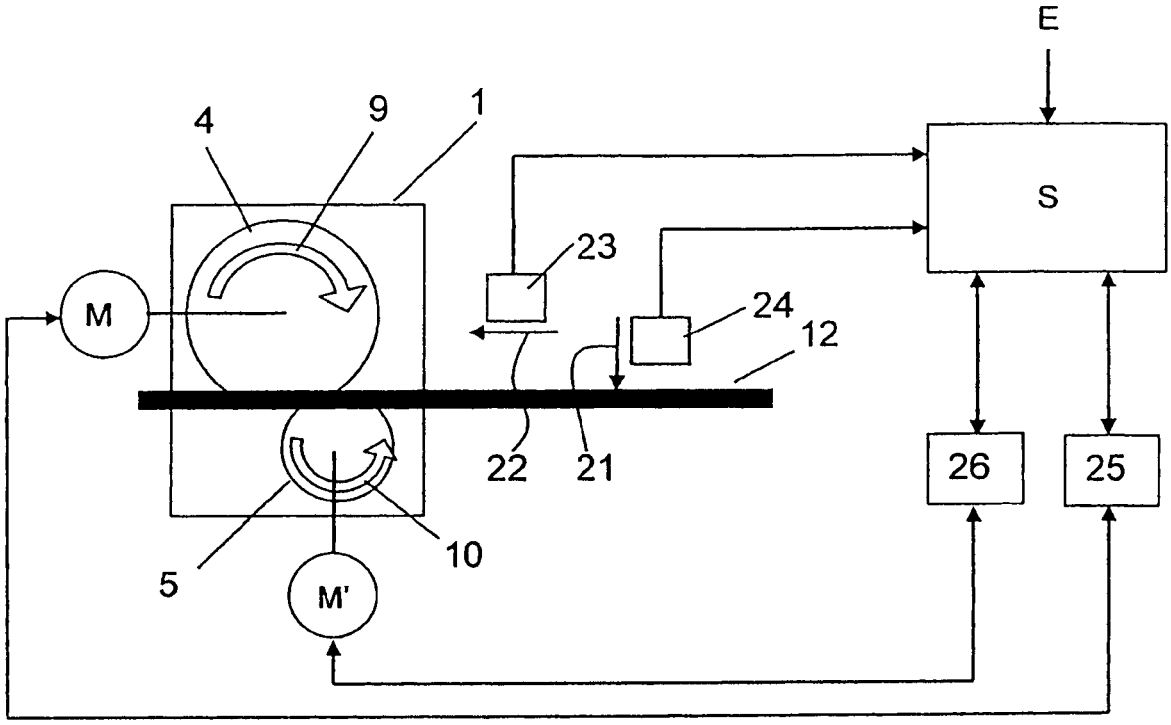
FIG. 3 A partial block diagram illustrating the control unit of the rotary cutter according to the invention.

The thickness H for the overlapping flow 12, indicated in FIG. 2, can vary considerably, depending on the products 13 and the arrangement of the products in the overlapping flow. Prior to the trimming operation, the thickness H is detected with the sensor 24, indicated in FIG. 3, or with the aid of another suitable measuring device. The sensor 24 can be a non-contacting distance measuring device, which measures in the direction of arrow 21 as shown in FIG. 3, or it can be a mechanical scanning device. The measured value for the thickness H is then supplied to a control unit S, which is connected to a speed regulator 25 for the motor M. If the second knife 5 is driven by the motor M', a control signal is also supplied to a speed regulator 26 for the motor M'. In addition to the thickness H, the speed of the overlapping flow 12 that is indicated with arrow 22 in FIG. 3, can be determined with a different sensor 23. The sensor 23 can operate non-contacting or can be a known mechanical speed indicator. One skilled in the art is familiar per se with method of measuring the speed of overlapping flows. The sensor 23 can also be integrated into the conveying device 11. The measured speed value is also supplied to the control unit S, which then supplies the corresponding signals to the speed regulator 25 and, if applicable, also to the speed regulator 26.

Based on the value for the measured thickness H and/or the measured conveying speed, the control unit S predetermines the rotational speed for the first knife 4, wherein this speed is calculated to ensure an optimum use of the cutting edge 16 during each trimming operation. An optimum use exists if the area 17, shown in FIG. 2, corresponds to approximately 70% of the total length of the cutting edge 16. The area 17 starts at the tip 18 and extends to the point of impact P that is shown in FIG. 2. This point of impact P is the point at which the cutting edge 16 impacts with the product 13 to be cut. The cutting edges 6 are thus utilized in the area 17 and, over time, will become dull in that area. The area 17 can also correspond to less than 70%, e.g. 60% or 50%, of the cutting edge 16 length. The shape of the cutting edge 16 is preferably straight between the tip 18 and the corner 20, but can also be non-straight.

If a motor M' is provided, then the control unit S can also calculate the speed of the second knife 5 based on a characteristic and in particular based on the thickness H and/or the speed of the overlapping flow 12, wherein the two motors M and M' are advantageously controlled separately. In that case, the rotational speeds of the two knives 4 and 5 can be adjusted optimally with respect to thickness and/or conveying speed of the overlapping flow 12. In principle, it is also possible to have a control that solely depends on the conveying speed or the thickness H. However, both variables may be taken into consideration. Of course, if the conveying speed of the overlapping flow 12 remains constant and unchanged, even for differently thick products 13, then the adjustment is based solely on the thickness H. If the thickness H remains constant and the conveying speed varies, then the adjustment is accordingly based on the conveying speed.

To compute the optimum speed for the first knife 4 and/or the second knife 5, additional characteristics of the overlapping flow 12 and/or the printed products can be supplied to the control unit S, either through manual input or by linking it to additional measuring devices.

With an optimum adjustment, each of the blades 6 intersects at an optimum angle with a plane representing the top 27 (FIG. 2) of a product 13, as explained above. During the trimming operation, the cutting edges 16 form a cutting curve 19 in the area 17. FIG. 2 shows that the cutting edges 16 move in the direction of arrow 15, and that the products 13 move in the direction of arrow 14. The blades 6 and the products 13 consequently move simultaneously during the trimming operation. FIG. 2 shows a blade 6 in the position where it hits the product 13 and a blade 6' which is in the process of leaving the product 13 following the trimming operation. If the speed of the products 13 and/or the thickness H changes, then the adjustment made by the aforementioned control unit S will adjust the rotational speed of the first knife 4 and, if applicable, also the rotational speed of the second knife 5. The circumferential speed of the first knife 4 is critical for the optimum positioning of the point of impact P, which in this case depends directly on the rotational speed.

The following table contains a plurality of possible adjustment cases.

| Case No. | Thickness H | Conveying speed v | Rotational speed of first knife | Rotational speed of second knife |
|---|---|---|---|---|
| 1 | larger/smaller | Same | higher/lower | same |
| 2 | larger/smaller | Same | same | higher/lower |
| 3 | larger/smaller | Same | higher/lower | higher/lower |
| 4 | Same | higher/lower | higher/lower | same |
| 5 | Same | higher/lower | same | higher/lower |
| 6 | Same | higher/lower | higher/lower | higher/lower |
| 7 | larger/smaller | higher/lower | higher/lower | same |
| 8 | larger/smaller | higher/lower | same | higher/lower |
| 9 | larger/smaller | higher/lower | higher/lower | higher/lower |

The conveying speed as well as the rotational speed of the second knife 5 remains the same for Case 1 in the above Table. If the thickness H of the overlapping flow 12 increases, then the rotational speed of the first knife 4 increases. However, if the thickness H decreases, the rotational speed of the first knife 4 decreases as well. For the adjustment, the blades 6 always start the trimming operation at the optimum point of impact P. In that case, only the rotational speed of the first knife 4 is adjusted based on the thickness H. For the above case 9, the thickness H and the conveying speed function as parameters for adjusting the rotational speed of the first knife 4 and the second knife 5. Still other cases are the result of using additional parameters for the control, e.g. the paper quality mentioned in the above. The optimum adjustment results in a longer service life as well as a uniform, optimum cutting quality.

The force generated at the knife shafts, or at least at one knife shaft, may also be considered for the adjustment. This force can be measured by the speed regulators 25 and 26, for example by measuring the current consumption at the motors M and/or M', and can be supplied to the control unit S for an evaluation. Conclusions can be drawn from this with respect to the state of the blades 6, the cutting edges 16 and/or the rings 8. With the aid of a corresponding indicator, it is possible to ensure that the blades 6 or the hard metal ring 8 are re-sharpened or replaced in time.

It will be understood that the above description of the present invention is susceptible to various modifications, changes and adaptations, and the same are intended to be comprehended within the meaning and range of equivalents of the appended claims.

What is claimed is:

1. A rotary cutter for trimming printed products, conveyed in an overlapping flow, the rotary cutter comprising:

a first knife that rotates;

a second knife that rotates counter to the first knife, wherein the second knife is arranged to operate jointly with the first knife and planes of faces of the first and second knives are arranged substantially perpendicular to the conveying direction;

wherein at least one of the first knife or the second knife includes a plurality of blades distributed over a circumference of at least one of the first knife or the second knife;

a conveying device to convey the overlapping flow between the first knife and the second knife;

a thickness measuring device arranged to detect a thickness of the overlapping flow;

a speed measuring device arranged to detect a speed of the overlapping flow; and a control unit coupled to receive outputs of the thickness measuring device and speed measuring device to automatically control and adjust a rotational speed of at least one of the first knife and the second knife based on the speed of the overlapping flow and the thickness of the overlapping flow.

2. The rotary cutter according to claim 1, wherein the first knife comprises the blades and the control unit adjusts the rotational speed for the first knife.

3. The rotary cutter according to claim 1, wherein the control unit adjusts the rotational speed for at least one of the first knife or the second knife.

4. The rotary cutter according to claim 1, further comprising a speed-controlled motor arranged to drive at least one of the first knife or the second knife in response to signals from the control unit.

5. The rotary cutter according to claim 1, further comprising a first speed-controlled motor and a second speed-controlled motor for driving the first knife and the second knife independently of one another.

6. The rotary cutter according to claim 5, further comprising a force measuring device for measuring a force generated at a driven knife shaft of at least one of the first knife or the second knife.

7. The rotary cutter according to claim 6, wherein the force measuring device determines the current consumption of at least one of the first speed-controlled motor or the second speed-controlled motor.

8. The rotary cutter according to claim 6, further comprising a speed regulator coupled to the control unit to regulate the rotational speed of the at least one of the first knife or the second knife based on the speed of the overlapping flow and the thickness of the overlapping flow, wherein the speed regulator comprises the force measuring device.

9. The rotary cutter according to claim 1, wherein each respective blade comprises a cutting edge and at least 50% the cutting edge in a longitudinal direction trims the overlapping flow, wherein the control unit controls the rotational speed of at least one of the first knife or the second knife to cause the at least 50% of the area to trim the overlapping flow.

10. The rotary cutter according to claim 1, further comprising a motor to drive the at least one of the first knife or the second knife; and a speed regulator coupled to the control unit to regulate the rotational speed of the at least one of the first knife or the second knife based on the speed of the overlapping flow and the thickness of the overlapping flow.

11. The rotary cutter according to claim 1, wherein the first knife comprises a segment knife including a disc carrier, wherein the plurality of blades are clamped onto the disc carrier.

12. The rotary cutter according to claim 1, wherein the second knife comprises a ring coupled to a disc-shaped support and the second knife automatically adjusts to the speed of the first knife.

13. The rotary cutter according to claim 1, wherein the conveying device includes the speed measuring device.

14. The rotary cutter according to claim 1, wherein each blade intersects the overlapping flow at an optimum angle with a plane of the overlapping flow and the cutting edge of each blade forms a cutting curve as the products are conveyed.

15. The rotary cutter according to claim 1, wherein the speed regulator is positioned between the control unit and the motor.

16. A rotary cutter for trimming printed products, conveyed in an overlapping flow, the rotary cutter comprising:

a first knife that rotates at a rotational speed and includes a plurality of blades distributed over a circumference of the first knife to trim the printed products;

a second knife comprising a ring that rotates counter to the first knife and operates jointly with the first knife, wherein the ring and the plurality of blades define a cutting gap;

a conveying device to convey the overlapping flow between the first knife and the second knife in a conveying direction;

a thickness sensor to detect and output a thickness of the overlapping flow;

a speed sensor to detect and output a speed of the overlapping flow; and a control unit coupled to receive the outputs of the thickness sensor and speed sensor, wherein the control unit uses the outputs to determine an optimum rotational speed and automatically adjusts the rotational speed of the first knife to the optimum rotational speed to cause at least 50% of a cutting edge in the longitudinal direction of each blade to trim the printed products.

17. The rotary cutter according to claim 10, wherein the thickness measuring device and the speed measuring device are positioned above the overlapping flow.

* * * * *